United States Patent [19]

Duguet

[11] 4,188,131

[45] Feb. 12, 1980

[54] SELF-SCRAPING MIXERS

[75] Inventor: Jean-Claude Duguet, Paris, France

[73] Assignee: Agence Nationale de Valorisation de la Recherche (ANVAR), Neuilly sur Seine, France

[21] Appl. No.: 922,588

[22] Filed: Jul. 6, 1978

[30] Foreign Application Priority Data

Jul. 8, 1977 [FR] France ..... 77 21104

[51] Int. Cl.[2] ..... B01F 7/16

[52] U.S. Cl. ..... 366/301

[58] Field of Search ..... 366/309-313, 366/297-301, 292, 97; 15/104.13, 104.16; 23/285, 286

[56] References Cited

U.S. PATENT DOCUMENTS

| | | | |
|---|---|---|---|
| 2,838,780 | 10/1954 | Kean | 15/104.13 |
| 3,734,468 | 5/1973 | Cheng et al. | 366/300 |

*Primary Examiner*—Philip R. Coe

*Attorney, Agent, or Firm*—Cushman, Darby & Cushman

[57] ABSTRACT

The invention relates to self-scraping mixers comprising a fixed case, at least two blades whose cross-sections are defined by at least two arcs of a circle of the same length and the same radius, and means for rotating said blades so that their edges scrape the whole area of inner face of the case as well as that of the outer faces of each blade. According to the invention, the mixers are of a conical type.

7 Claims, 2 Drawing Figures

SELF-SCRAPING MIXERS

The invention relates to mixers for mixing and transferring products of low or average consistency such as loose or granular materials, powders, pastes and/or liquids of low or average viscosity.

Such self-cleaning mixers are known comprising a fixed case, at least two blades whose cross-sections are delimited by at least two arcs of a circle of the same length and the same radius, and means for rotating these blades about their axes, said blades being arranged and dimensioned so that during their rotation their edges scrape the whole area of the inner lateral face of the case as well as that of the faces of each blade, these blades remaining constantly staggered by the same angle in relation to each other when they are in mutual contact.

In known mixers of this type, the case is cylindrical and the axes of the blades are parallel to each other.

It has not been possible up to present to propose such apparatus of a conical type, i.e. with converging axes for the rotary blades, because of the difficulties of design and construction of such apparatus, experience showing that the profiles devised for the parallel axis blades are no longer suitable when the axes of these blades are inclined in relation to each other; by their very definition these profiles disregard the inclination of the axes of the blades.

The invention makes possible such "conical" type designs and constructions, which opens up the field to a large number of new and interesting applications using truncated cone shaped hoppers for supplying receptacles with granular, powdery, pasty, liquid or similar mixtures.

The conical type mixers of the invention have in particular the advantage of avoiding any adherence of the products to be mixed on the walls of the blades and hoppers as well as the advantage of an excellent homogeneity of the mixtures obtained.

So as to make the axes of the rotary blades convergent in mixers of the kind in question while still maintaining their feature of complete self-cleaning, according to the invention, radius R of the arcs of a circle delimiting the cross-section of each of these blades is given the value $$\frac{KD}{2}\cdot\left(m+\frac{1-K^2}{m}\right),$$

in which the coefficient K is equal to the cosine of half of the stagger angle between the blades in mutual contact, D is the diameter of the envelope circle of the cross-section of a blade during its rotation and m is equal to $$\frac{1-K+(1-2K^2+K^3)\,tg^2 B}{1+K\cdot(2-K)\cdot tg^2 B}$$

B being the semi-angle at the apex, at least equal to 5 degrees and preferably between 10 and 30 degrees, of the envelope conical surface of a blade during its rotation.

The invention comprises, apart from this main arrangement, certain other arrangements which are used preferably at the same time and which will be more explicity discussed hereafter.

In what follows there will be described a particular embodiment of the invention with reference to the accompanying drawing in, of course, a non limiting manner.

Figure 1:
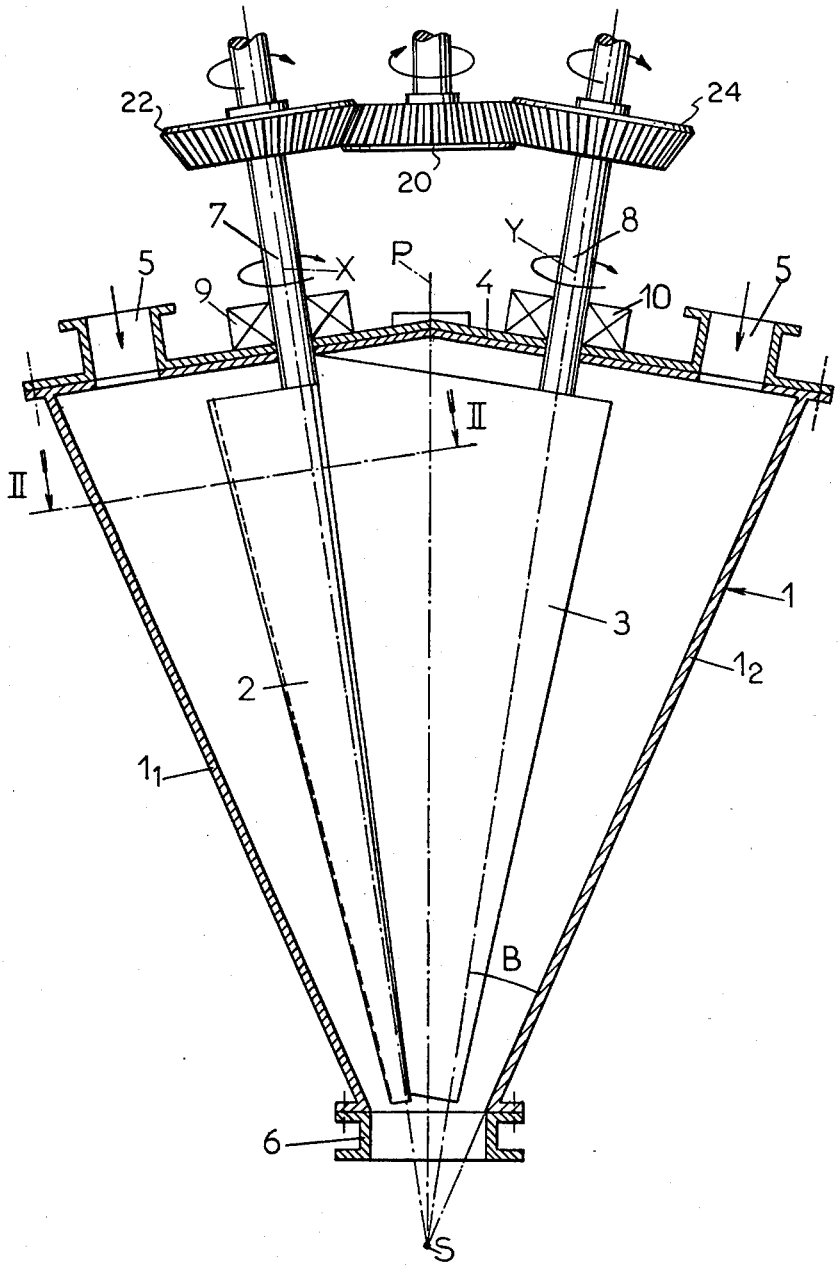
Figure 2:
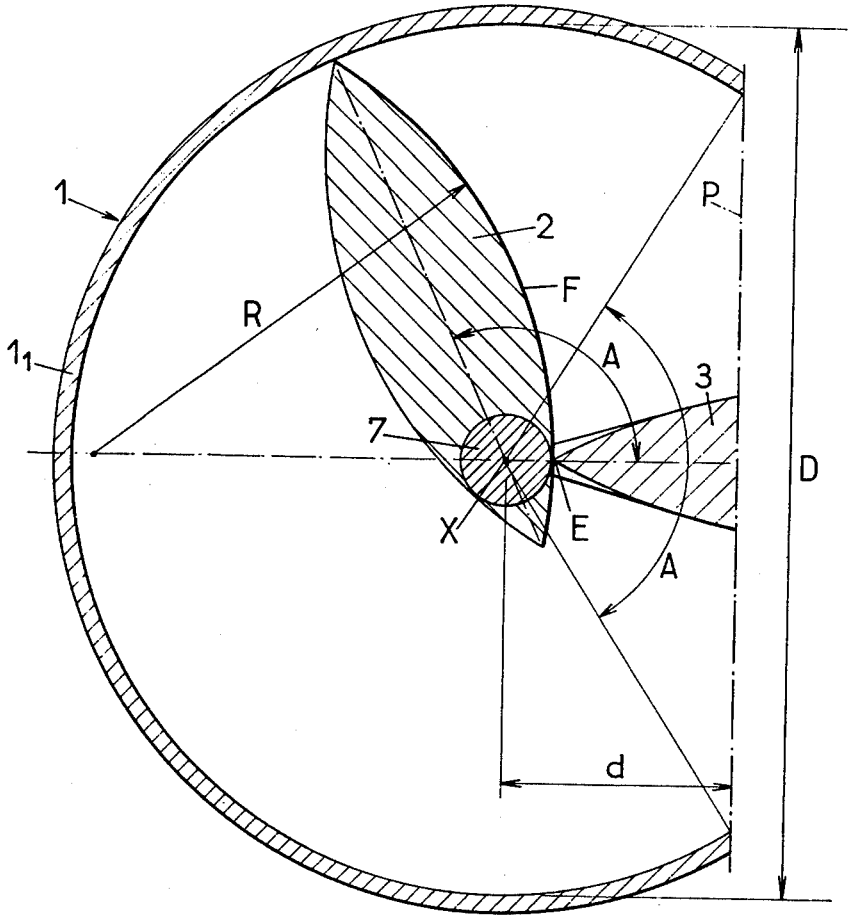

FIGS. 1 and 2 of this drawing show respectively, in a side view with the case cut away and a half cross-section along II—II of FIG. 1, a self-cleaning mixer constructed in accordance with the invention.

This mixer comprises a biconical hopper 1 converging downwards, two rotary blades 2 and 3 contained in this hopper and means for rotating these two blades about axes X and Y which converge at a low point S.

Hopper 1 is formed from two identical truncated cones of revolution $\mathbf{1}_1$ and $\mathbf{1}_2$ with respective axes X and Y and apex S intersecting along a vertical plane P and symmetrical to each other in relation to this plane.

Said hopper is closed at its upper part by a lid 4 provided with apertures 5 for feeding in the products to be mixed and it is connected at its lower end to a flange 6 for discharging the mixture obtained.

Each of the two blades has the general shape of a truncated cone with apex S, whose cross-section, i.e. considered perpendicularly to the corresponding axis X or Y, is defined by two arcs of a circle having the same radius: in other words this cross-section is that of a symmetrical bi-convex lens and the connection points of these two arcs of a circle delimit rectilinear scraper edges one of which extends along a generatrix of one of the truncated cones $\mathbf{1}_1$ and $\mathbf{1}_2$ forming the inner surface of the hopper.

The plane of symmetry of each blade containing the two scraper edges of this blade passes through the corresponding axis X or Y.

The axis of rotation of each blade, X or Y, could from an axis of symmetry for this blade, i.e. coincide with the axis of symmetry of the different cross-sections of said blade. This is however only possible for discrete values of stagger angle A, such as 90°. The two blades then conserve their permanent mutual contact.

But in the embodiment illustrated, each axis of rotation X or Y is offset in relation to the axis of symmetry of the corresponding blade while remaining inside said blade, in its plane of symmetry containing the two scraper edges.

As can be seen in FIG. 2, the angular spacing apart of the two axes X and Y is such that, for certain angular sectors of each blade, there exists a mutual contact between one of the scraping edges E of one blade and a face F of the other blade.

The applicant has worked out that, under these conditions, and irrespective of whether the axes of rotation X and Y are offset or not in relation to the corresponding geometrical axes, if we designate:

A the angle of stagger between the two blades, considered in the plane of the cross-section of one of them, such as the plane of FIG. 2, and included between 0° and 180°, K the cosine of half of this angle A, B the half angle at the apex of any one of the cones $\mathbf{1}_1$ and $\mathbf{1}_2$, D the diameter of the envelope of a blade cross-section, such as that of blade 2 shown in FIG. 2, and m the quantity defined by the formula $$m=\frac{1-K+(1-2K^2+K^3)\,tg^2 B}{1+K(2-K)\,tg^2 B}$$

it is necessary to give to the radius R of each arc of a circle delimiting the cross-section considered the value defined by the formula $$R = \frac{KD}{2} \times (m + \frac{1 - K^2}{m})$$

for the above mutual contact to be maintained during the whole period that face F considered moves past edge E.

This equality must have regard to the framework of tolerances usually admitted in this field, which are generally of the order of a fraction of a mm.

We can then note, as for the constructions with parallel axes, a complete self-cleaning not only of the inner face of hopper 1 but also of the outer faces of the blades when the mixer is operated by rotation of these blades.

In particular no jamming of the machine is to be noted and no local deposits of products to be mixed on the surfaces which guide them.

In the case where a centred type of blade is adopted with permanent mutual contact between the two blades, it is sufficient to drive these latter at the same speed to ensure the operation in question.

This advantage of a relatively simple drive has as a counterpart a relatively large part of the inner volume of the hopper taken up by the blades so that the overall output of products to be mixed is relatively small.

In the variation with offset blades which has been shown in the drawing, the volume available inside the hopper for the products to be mixed is relatively large, but the mutual contact between the blades is periodically broken and, if these blades are rotated at identical speeds, only one face of each blade is subjected to the self-cleaning scraping.

To remedy this disadvantage and to ensure complete scraping of both faces of each blade, in accordance with an advantageous arrangement of the invention, the angle of mutual stagger of the two blades is reversed during their absence of mutual contact by provisionally accelerating (or slowing down) one of these two blades in relation to the other, the accelerated (or slowed down) blades during successive periods of absence of mutual contact being permutated in turns.

Thus, in the embodiment described, it is sufficient for a blade to describe an angle three times greater than the other blade during each period of absence of mutual contact.

More precisely, in their hypothesis, cycles may be noted each corresponding to a rotation of two revolutions of each blade and each comprising four successive periods, viz.

a first mutual scraping period corresponding to an angular displacement of $2\pi - 2A$ at the same speed for both blades then mutually staggered by angle A, a second period of absence of scraping during which one of the blades describes an angle A whereas the other blade describes an angle 3A, a third period of scraping corresponding to a new angular displacement of $2\pi - 2A$ at the same speed for both blades then staggered by angle $-A$ in relation to each other, and finally a fourth period of absence of scraping during which the first blade above describes an angle 3A whereas the other blade describes an angle A.

The speed variations imposed successively on the two blaces may be continuous and generated by means of a variable speed generator or on the contrary discontinuous and obtained by means of a speed change device.

The blades may be driven in any desirable way.

In particular, a central driving bevel gear 20 may be used with a vertical axis capable of driving two bevel gears, 22 and 24, integral, respectively, with the two blades 2 and 3 and operating as planet wheels, the case then having the shape of a truncated cone of revolution.

In FIG. 1 can be seen journals 7 and 8 with axes X and Y integral respectively with blades 2 and 3, mounted and supported in cantilever fashion in axial thrust bearings 9 and 10 themselves carried by lid 4.

Of course, other journals and bearings could be provided at the base of the blades so as to avoid their cantilever mounting, but this would then be to the detriment of the flow facilities of the mixture obtained outside the hopper.

Although full blades have been shown in the drawing, they could be partially cut away, to give them particularly the shape of a "Z" arm, conventional in the mixing technique, this at the price of incomplete self-scraping, but nevertheless of sufficient frequency.

It follows from the above description that, if one places oneself in the plane of FIG. 2, the angle at which the middle narrowing of the biconical hopper from the point where axis X pierces this plane is equal to A, distance d between said point where axis X pierces the plane considered and the intersection of this plane with plane P is equal to KD/2.

In an embodiment having given every satisfaction and explained purely by way of illustration, above angle A was equal to 114° and above angle B was equal to 15°, which gave for radius R a value equal to 0.51D, for the free section of the inside of the hopper a value of the order of 87% and for the slope from the vertical of each of axes X and Y a value of 8¼ degrees, which gives a total opening angle of 46½ degrees for the hopper.

As is evident and as it follows from what has gone before, the invention is in no wise limited to those of its modes of application and embodiments which have been more especially considered; it embraces, on the contrary, all variations thereof, particularly:

those where the number of the arcs of a circle delimiting each blade cross-section are greater than 2, and particularly equal to 3, the cross-section in question then having the form of bulging curvilinear equilateral triangles, those in which the number of blades is greater than 2, and particularly equal to 3, 4, 5 or 6, those in which the general orientation of the axis of the hopper is other than vertical, and for example oblique, those in which the scraping edges are truncated or thickened so as to reduce their mechanical fragility, the above rules allowing in this case also complete self-cleaning to be maintained, those in which each blade is formed not from a single, but from several truncated cones stacked on one another.

I claim:

1. A self-cleaning mixer comprising a housing having a top and side wall members which together define an inner chamber, said inner chamber having an inner face, at least two blades rotatably mounted within the housing, said blades having a cross section defined by at least two arcs of a circle having the same length and the same radius R, and means for rotating these blades about their axes, said blades being arranged and dimensioned so that during their rotation their edges scrape the inner face of the inner chamber as well as the lateral faces of each blade, these blades remaining constantly staggered in relation to each other by the same angle A when they are in mutual contact, the inner face of the inner chamber and the outer faces of the blades extending along truncated cones having the same apex with the axes of rotation of the blades passing through this apex wherein the radius R is given by the formula:

$$R = \frac{KD}{2} \cdot (m + \frac{1 - K^2}{m}) \quad (1)$$

in which the coefficient K is equal to cos A/2, D is the diameter of the envelope circle of the cross-section of a blade during its rotation and m is given by the formula:

$$m = \frac{1 - K + (1 - 2K^2 + K^3) \cdot tg^2 B}{1 + K \cdot (2 - K) \cdot tg^2 B} \quad (2)$$

where angle B is the semi-angle at the apex, at least equal to 5 degrees, of the envelope conical surface of a blade during its rotation.

2. A mixer according to claim 1, characterized in that angle B is between 10° and 30°.

3. A mixer according to any one of claims 1 and 2, characterized in that the axes of rotation of the blades pass through the geometrical centres of their cross-sections.

4. A mixer according to any one of claims 1 and 2, characterized in that the number of arcs of a circle delimiting the cross-section of each blade being equal to two and the axis of rotation of each blade being offset in relation to the geometrical centre of the cross-section of this blade, but disposed in the plane of symmetry containing the edges of said blade, the means for rotating these latter are arranged so as to increase the speed of rotation of one of the two blades in relation to the other when these blades are not in mutual contact so as to reverse the mutual stagger angle of the two blades between loss of said contact and resumption of this contact.

5. A mixer according to claim 4, characterized in that the means for driving the blades are arranged so as to cause one of the blades to travel through an angle three times greater than that travelled by the other during the absence of mutual contact of these two blades, the accelerated blade being permutated after each scraping of the blade face by an edge of the other blade.

6. A mixer according to claim 1, characterized in that each blade is orientated so that its axis of rotation is slightly inclined from the vertical and is mounted cantilever fashion on an upper journal coaxial with its axis of rotation and supported by the case by means of suitable axial stops.

7. A mixer according to claim 1, characterized in that the means for driving the blades comprise a central bevel gear, the blades then rotating as planet wheels around this pinion and their common case being a truncated cone of revolution.

* * * * *